United States Patent [19]

Ferguson

[11] 4,142,519

[45] Mar. 6, 1979

[54] MASSAGING APPARATUS

[76] Inventor: Robert K. Ferguson, Box 792, Babbitt, Nev. 89416

[21] Appl. No.: 923,686

[22] Filed: Jul. 11, 1978

[51] Int. Cl.[2] ..... A61H 15/00

[52] U.S. Cl. ..... 128/57; 128/25 B

[58] Field of Search ..... 128/57, 25 B, 58, 56

[56] References Cited

U.S. PATENT DOCUMENTS

| | | | |
|---|---|---|---|
| 1,780,479 | 11/1930 | Griffith | 128/57 |
| 2,072,959 | 3/1937 | Mulvaney | 128/57 |
| 2,663,293 | 12/1953 | Elliott | 128/56 |
| 2,767,707 | 10/1956 | Toivonen | 128/25 B |

FOREIGN PATENT DOCUMENTS

| | | | |
|---|---|---|---|
| 2323851 | 11/1974 | Fed. Rep. of Germany | 128/57 |
| 593684 | 4/1976 | Switzerland | 128/57 |

*Primary Examiner*—Lawrence W. Trapp

*Attorney, Agent, or Firm*—Folsom E. Drummond

[57] ABSTRACT

A massager which comprises a resilient massaging roller, the periphery of which is studded with flanged protuberances, the roller being removably mounted for rotation on spaced upright members secured to a base member or platform, the latter being movable back and forth by the user to position and manipulate the roller during the massaging operation.

6 Claims, 9 Drawing Figures

MASSAGING APPARATUS

My invention relates to massaging apparatus to massage and manipulate body tissues for remedial or hygienic purposes. More particularly my invention provides an apparatus of relatively simple construction which is easy to operate, and is very effective for massaging body tissues such as the feet, legs, calf of legs, thighs and the like body elements.

There has been heretofore described in the prior art various types of massaging devices and machines comprising rollers and the like means. Insofar as known, however, a massager constructed and operated in accordance with my present invention has not been devised.

It is a principal object of my invention to provide a massager which comprises a resilient massaging roller, the surface of which is studded with flanged protuberances which function to dislodge and remove dry or dead skin during the massaging treatment of the body tissue.

Another object of my invention is to provide an apparatus or appliance for massaging purposes which is very efficient, and is readily operated by the user without the need of electrical or other energy sources.

Another object of my invention is to provide a massager which is economical to construct and is arranged to be moved back and forth by the user while in a sitting or lounging position, massaging being effected by a resilient roller during such movement.

A further object of my invention is to provide a massager of the character referred to wherein the massaging roller is rotatably and removably supported on a base member.

These and other objects, features and advantages of my invention will be readily apparent from the following detailed description of a typical and preferred massager of this invention.

A massager embodying the principal features and illustrating my invention is shown in the accompanying drawings, throughout, which descriptive reference characters are utilized, and wherein.

Figure 1:
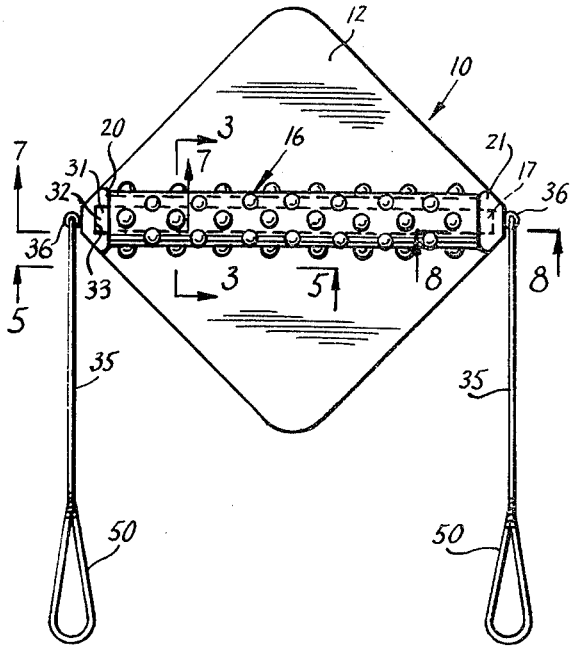
FIG. 1 is a plan view of a preferred embodiment of my invention.
Figure 3:
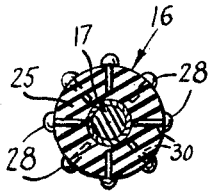
FIG. 3 is a cross-section taken through the massaging roller, at 3—3 of FIG. 1, and looking in the direction of the arrows.
Figure 4:
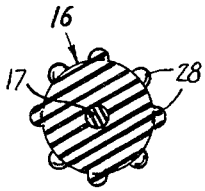
FIG. 4 is a cross-sectional view of a roller similar to FIG. 3 and illustrating a modification.

Referring to the drawings, wherein like reference characters indicate like parts, a massager of preferred construction and operation is illustrated in FIG. 1. The massager 10 comprises a base member 12 which is preferably rectangular in shape, as shown, and is engaged by the user during use of the massager.

Mounted for rotation on the base member 12 is a massaging roller 16, the same comprising a shaft 17, the opposite ends of which are suitably journalled in spaced upright members 20 and 21. The upright members are firmly secured to the base members 12, e.g., by wood screws which extend up through the base member into the base of the uprights. The massaging roller 16, which preferably is about twelve to fifteen inches in length and two to three inches in diameter, is supported by the uprights above the base member a sufficient distance to permit the user to engage the base member, e.g., with the foot, and manipulate the massager during use. The user may, of course, grasp the base member and turn the massager over or sideways, as desired, when applying the massaging roller to different parts of the body.

Figure 9:
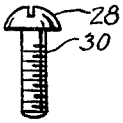
FIG. 9 illustrates a machine screw or bolt having the flanged head screw structure and utilized to provide the studded protuberances of the massaging roller.

The massaging roller 16 comprises a cylinder having a resilient outer layer 25, preferably composed of rubber. A resilient plastic which is capable of retaining the studded protuberances may be used instead of rubber. The peripheral surface of the massaging roller is studded throughout its length with flanged protuberances 28, as shown in FIG. 1, which preferably consist of machine screws or bolts, e.g., three eights inch size, or the like, as illustrated in FIG. 9. The machine screw heads protrude above the surface of the roller, e.g., aboht one-eight of an inch, while the threaded shank portion 30 is embedded in the body of the roller. Such construction provides resilient raised protuberances having flanged head structure which serve to penetrate into the tissue and stimulate the circulation to the extent desired and give the most relief possible to the user.

To permit easy changing of the roller, or substitution of the same, one end of the roller shaft 17, as at 20, is removably retained in the journal socket 31 by a plug 32. This plug is adapted to fit in a slot 33 in upright 20 which is open at the top and wide enough to accommodate the end of the shaft 17. The arrangement permits the roller to be raised out of the journal socket and away from the supporting upright 20 when the plug 32 is removed. The plug 32 is suitably retained in place by a screw as at 34. This construction is best shown in FIG. 7.

Figure 5:
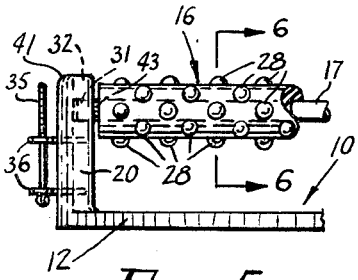
FIG. 5 is a fragmentary view in elevation of the massager shown in FIG. 1, as indicated at 5—5, and illustrating the slotted journal construction at one end support for the roller whereby the roller is made readily removable.
Figure 2:
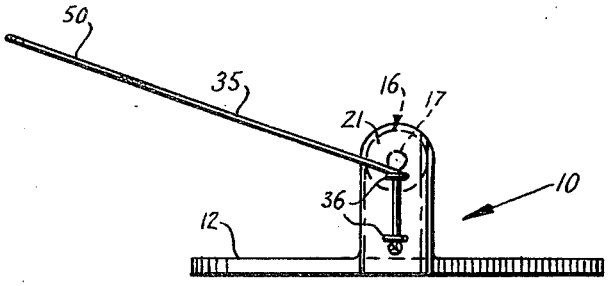
FIG. 2 is a right side elevation view of the massager illustrated in FIG. 1.
Figure 7:
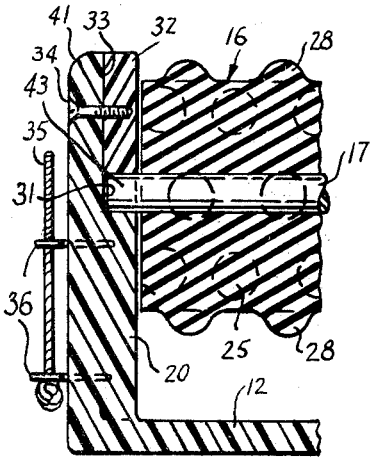
FIG. 7 is an enlarged fragmentary sectional view taken on line 7—7 of FIG. 1 and illustrating the slotted journal construction and removable plug means for retaining one end of the roller shaft in place.
Figure 6:
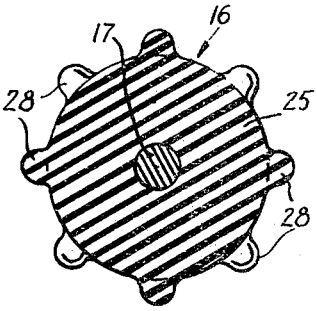
FIG. 6 is an enlarged sectional view taken on line 6—6 of FIG. 5 and looking in the direction of the arrows.
Figure 8:
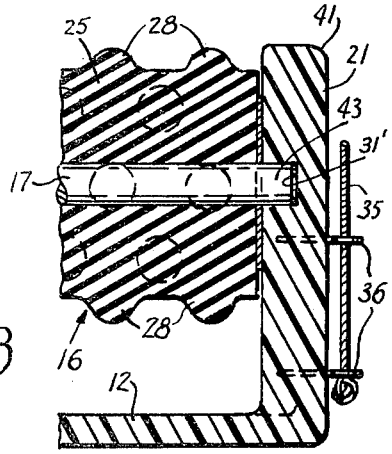
FIG. 8 is a similar view as in FIG. 7 and showing the socket type journal construction for rotatably supporting the opposite end of the roller.

For guiding and manipulating the massaging apparatus, cords 35 of suitable length are provided, the cords being fastened to the uprights 20 and 21 by means of the vertically spaced eye bolts 36 as best illustrated in FIGS. 7 and 8. The base member 12 may be made of plywood, plastic, metal or the like, and which has smooth, even bottom as well as side surfaces. Likewise, the upright members 20 and 21 are shaped to conform with the outer edges of the base member 12, as shown in FIG. 1, and comprise rounded, smooth upper surfaces, 40 and 41, as shown in FIGS. 7 and 8. As a modification, the massaging roller body may be of solid rubber or plastic, as aforementioned, with stub shafts as suitably journalled in the spaced upright members 20 and 21, and such as illustrated in FIGS. 5 and 6. Further, the protuberances 45, comprising the flanged studs may be cast or molded into the surface of the roller.

In operating the massager of my invention, for example, to massage the calf of a user's leg, the massager may be placed on the floor or like supporting surface and the leg to be massaged placed on top of the massaging roller. The massager is then pushed forward by contacting the base member and guiding the same back and forth with the cords to thus manipulate the massaging roller. Where my massager is used to treat one's feet, the massaging roller is engaged by the feet and the roller positioned advantageously to all parts of the feet while in motion on the roller. To apply pressure on the feet, the user merely puts the cord loops 50 on the knee and raises up slightly to exert pressure or may put one foot on top of the other to produce the pressure desired. The machine screw heads forming the proturbances on the roller thus effectively clear away dry or dead skin and dislodge horny indurations, etc. To massage the thighs and other parts of the user's body, the massaging apparatus may be turned over and the massaging roller applied to the body tissue to be massaged, as described. The massager also may be contained in a suitably constructed box or receptacle and utilized for transporting and using the massager in any way deemed advantageous.

Having described a typical and a modified massager of my invention, I do not wish to be limited or restricted to the specific details herein set forth, but wish to reserve to myself any variations or substitutions that may occur to those skilled in the art and fall within the scope of the following claims:

What I claim is:

1. A massager for massaging body tissues comprising a resilient massaging roller rotatably and removably mounted on a base member, the periphery of said roller being studded with flanged protuberances, and said massager having means secured thereto for guiding and manipulating the roller during the massaging operation, said flanged protuberances comprising machine screw head means having screw-driver slots thereon, and wherein said head means are spaced above the surface of the roller, said roller being made of rubber or resilient plastic material and journalled in spaced upright means secured to said base member.

2. A massager as in claim 1 wherein cord means secured to the massager is utilized to guide and manipulate the roller during the massaging operation.

3. A massager as in claim 1 wherein the base and upright means comprise an integral unit.

4. A massager as in claim 1 wherein one end of the massaging roller is removably mounted.

5. A massager as in claim 1 wherein the roller is journalled at one end in an open-ended slot section.

6. A massager as in claim 1 wherein the upright means are shaped to conform with the outer edges of the base member and comprise rounded, smooth surfaces.

* * * * *